United States Patent [19]

Masuda et al.

[11] 4,428,661

[45] Jan. 31, 1984

[54] MAGNETIC BRUSH TYPE DEVELOPING DEVICE

[75] Inventors: Keiji Masuda; Shinobu Fujiwara; Kenichi Matsumoto, all of Hachioji, Japan

[73] Assignee: Konishiroku Photo Industry Co., Ltd., Tokyo, Japan

[21] Appl. No.: 348,259

[22] Filed: Feb. 12, 1982

[30] Foreign Application Priority Data

Mar. 9, 1981 [JP] Japan ..... 56-32503

[51] Int. Cl.[3] ..... G03G 15/08

[52] U.S. Cl. ..... 355/3 DD; 355/14 D; 118/658

[58] Field of Search ..... 355/3 DD, 14 D; 118/657, 658

[56] References Cited

U.S. PATENT DOCUMENTS 4,213,617 7/1980 Salger ..... 355/3 DD X

*Primary Examiner*—A. C. Prescott

*Attorney, Agent, or Firm*—Frishauf, Holtz, Goodman & Woodward

[57] ABSTRACT

A magnetic brush developing device for developing an electrostatic latent image formed on a charge retaining member includes a housing for containing developer, a developing sleeve arranged rotatably in the housing, a plurality of magnets interior of the developing sleeve, a doctor blade for regulating a thickness of a developer layer formed on a circumferential surface of the developing sleeve by a magnetic flux of the magnets, and a magnetic material fixed on an internal surface of the housing and downstream of the doctor blade as viewed from the direction of the rotation of the developing sleeve. The magnetic material extends in the direction of the width of the developing sleeve, is spaced from the circumferential surface of the developing sleeve, and is positioned opposite to at least one of the magnets arranged in the developing sleeve.

12 Claims, 2 Drawing Figures

MAGNETIC BRUSH TYPE DEVELOPING DEVICE

BACKGROUND OF THE INVENTION

1. Field of the Invention

The present invention relates to a magnet brush type developing device in an electrophotographic copying machine and the like.

2. Description of the Prior Art

As is generally known, a magnetic brush type developing means is equipped with a developing sleeve that is rotatably stored in a box-like housing containing developer and which includes a plurality of permanent magnets, an agitating blade rotatably mounted in the bottom of the housing positioned behind said developing sleeve and which frictionally electrifies toner by agitating, and a doctor blade provided inside the housing facing the circumferential surface of said developing sleeve for regulating the thickness of a developer layer formed on the circumferential surface of the developing sleeve by the magnetic flux of the permanent magnets.

Heretofore, in an electrophotographic copying machine using the magnetic brush type developing device, there was a tendency to increase the driving speed of each part of the machine in order to increase the hourly processing capability. In the high speed copying machine of this kind, the consumption of toner is remarkably increased. The increase in toner consumption necessitates the increase of rotation speed of the developing sleeve and the agitating blade in the magnetic brush type developing means. Consequently, in the housing of said magnetic brush type developing device, a large quantity of floating toner is produced owing to high speed rotation of the agitating blade. The floating toner rides on the air current in the chamber which has been accompanied by the rotating motion of the developing sleeve, is discharged from the housing, and then is adhered to various processing devices in the copying machine, thus to cause a variety of difficulties.

To cope therewith, the present inventors have attempted the countermeasure in providing a vacuum inlet port at the opening of the developing device to remove floating toner being discharged from the housing, and the countermeasure in narrowing the gap between the internal surface of the housing and the circumferential surface of the developing sleeve, which is the path of the floating toner being discharged. However, those countermeasures were confronted with the following problems. That is, in the countermeasure in providing a vacuum inlet port, it is possible to remove the floating toner. However, with a high speed developing device, floating toner is discharged in large quantity and a filter is stopped or clogs too early. Therefore it was difficult to put this first countermeasure to practical use. In the construction in narrowing the discharging path, it was expected that the discharge of floating toner could be obstructed by the ears of developer formed on the circumferential surface of the developing sleeve. However, the construction was not very effective and the discharging quantity of floating toner was not changed very much compared with that before the countermeasure was taken.

SUMMARY OF THE INVENTION

It is an object of the present invention to provide a magnetic brush type developing device which solves the above mentioned problems.

The above object of the present invention is accomplished by a magnetic brush developing device for developing an electrostatic latent image on a charge retaining member, which comprises a developing sleeve stored rotatably in a housing containing developer and built-in with a plurality of magnets, a doctor blade for regulating a thickness of a develope layer formed on the circumferential surface of said developing sleeve by a magnetic flux of said magnets, and a magnetic material fixed on the internal surace of said housing and downstream of said doctor blade as viewed from the direction of the rotation of said developing sleeve, extended to the direction of the developing width of said sleeve, separated from said circumferential surface of the developing sleeve, and positioned opposite to one of said magnets.

DETAILED DESCRIPTION OF THE PREFERRED EMBODIMENTS

Figure 1:
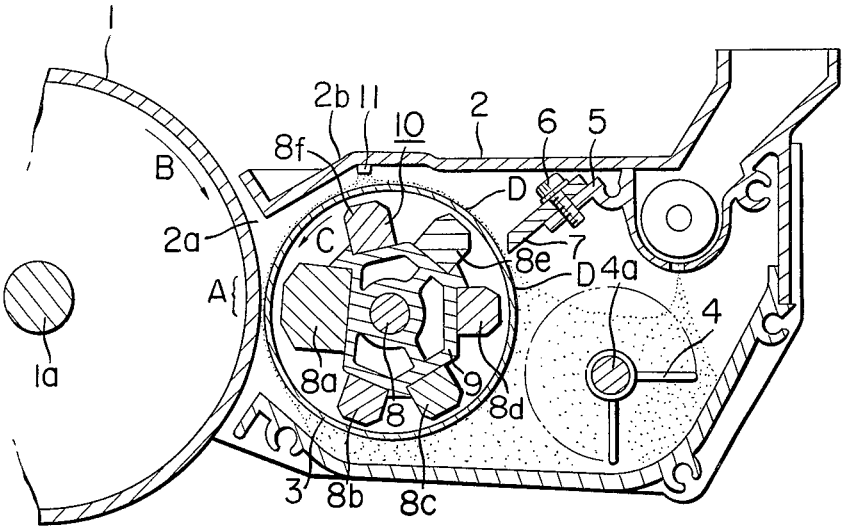
FIG. 1 is a cross-sectional view of the magnetic brush type developing an electrophotographic copying machine according to the present invention.

In FIG. 1, a magnetic brush type developing device comprises a box-like housing 2 of which an opening 2*a* faces on a photosensitive drum which is rotatably supported by a fixed supporting sheet 1*a* and 1 of which the surface is composed of a photoconductive material such as selenium. In said housing 2 is stored a two-component developer comprising a magnetic carrier and toner for developing an electrostatically charged image. In the housing 2, there is incorporated a cylindrical developing sleeve 3 made of nonmagnetic material, of which a part of the circumferential surface faces developing area A on photosensitive drum 1 through opening 2*a* and which rotates in the same direction (of arrow C) as the direction B of the rotation of photosensitive drum 1. An agitating blade 4 which is rotatably mounted by a supporting shaft 4*a* in the bottom of housing 2 positioned behind said developing sleeve 3 and which frictionally electrifies toner by agitation developer in housing 2. A doctor blade 7 is provided the base of which is fixed to a fitting piece 5 provided integrally with the upper part of the inside of housing 2 by means of a fitting screw 6 and the free edge of which is spaced from the circumferential surface of the developing sleeve 3 that is described hereafter and which regulates the thickness of a developer layer formed on the circumferential surface of developing sleeve 3. Also, to a fixed supporting shaft 8 positioned inside said developing sleeve 3, there is mounted a fixed core 9 having a smaller outside diameter than the inside diameter of said developing sleeve 3, and said fixed core 9 is fixed to said supporting shaft 8. On the circumferential surface of said fixed core 9, a plurality of bar-like permanent magnets 10 extending in the direction of the width of developing sleeve 3 are arranged so that they can be adjoined with each other in the direction of the circumference of core 9. Said permanent magnets 10 are polarized in the radial direction of core 9 and fixed to core 9 in the state such that the polarities of each of the adjacent permanent magnets 10 are opposite. Each pole face of said permanent magnets 10 faces the internal surface of developing sleeve 3 with a small space and one of said permanent magnets 10 is arranged opposite to developing area A on photosensitive drum 1. Accordingly, developer being stored in housing 2 is agitated by the agitating blade 4, and during that time toner is frictionally charged and then absorbed onto the circumferential surface of developing sleeve 3 by the magnetic flux of permanent magnets 8*b*–8*d* and thus developer layer D is formed. Thereafter, developer layer D is transported to doctor blade 7 by the rotation of developing sleeve 3 and the thickness thereof is made uniform by means of doctor blade 7, and is then transferred to developing area A on photosensitive drum 1.

Figure 2:
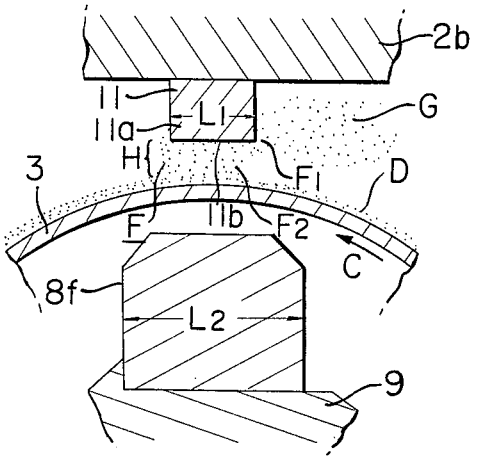
FIG. 2 is an enlarged cross-sectional view of the essential parts of the developing device shown in FIG. 1.

On the other hand, according to the present invention, a bar-like iron piece 11 extending in the direction of the width of developing sleeve 3 is adhesively fixed to a top-wall 2*b* of housing 2. Iron piece 11 is fitted, as shown in FIG. 2, to top-wall 2*b* without any gap between them by making use of a bonding agent. A lower free end 11*a* of iron piece 11 is faced opposite to one of the permanent magnets, that is permanent magnet 8*f*, which is positioned behind doctor blade 7 as views from the direction of the rotation of developing sleeve 3, with the interposition of the circumferential wall of developing sleeve 3. Therefore, small space H is formed between the surface 11*b* of the lower free end 11*a* and the circumferential surface of the developing sleeve 3 so that the aforesaid developer D can pass through space H. Width L1 across iron piece 11 is preferably made narrower, if possible, than width L2 across permanent magnet 8*f* in order to form a fine induction magnetic flux between permanent magnet 8*f* and iron piece 11. Iron piece 11 may be substituted by other ferromagnetic material without any limitation thereto. Preferring to the fitting of iron piece 11 to housing 2, it is also possible that a through hole is made in housing 2 and the base of said iron piece 11 is seatedly fitted to housing 2 by means of a fitting screw which is passed through said through hole, and in this case, it is also possible to increase the adhesiveness of the seating surface of iron piece 11 to housing 2 by interposing between them a space such as rubber, synthetic resin or soft metal.

As a magnetic brush type developing means of the invention has the constitution as described above, in the space where there has so far been the path for toner-flow in a conventional magnetic brush type developing means, there is now formed an induction magnetic field focussed by permanent magnet 8*f* and bar-like iron piece 11, and the ears (i.e. accumulations) of developer F are uniformly formed on the whole of space H in the direction of the width of developing sleeve 3. Referring more particularly to the state of the ears of developer F in accordance with FIG. 2, ears of developer F1 come in close contact with free end 11*a* and are at rest, or stationary and the ears of developer F2 formed on the circumferential surface of developing sleeve 3 get swollen slightly toward ears F1 which are still at rest. Therefore, the space between the circumferential surface of developing sleeve 3 and the ferromagnetic material, i.e., iron piece 11, is choked up or blocked with ears of (i.e. accumulations) developer F1 and ears of developer F2 and thus toners G floating in housing 2 is prevented from flowing out of housing 2 by ears F1 and F2 of developer.

In the example shown in the drawings, it is described that the width L1 across iron piece 11 is made narrower than width L2 across permanent magnet 8*f*. However, there are some instances where said width L1 is made wider than width L2 in accordance with the physical property of ferromagnetic material, the density of the magnetic flux of permanent magnets, the quantity of floating toner, the rotation speed of developing sleeve and the like.

As is obvious from the above description, according to the present invention, it is possible to positively prevent toner securely from flowing out without any maintenance and control, but with a simple improvement of additionally fitting a bar-like iron piece which forms an induction magnetic field in the toner flowing space of a conventional magnetic brush type developing device. Moreover, the ears of developer can be formed by the induction magnetic field, and therefore, there can be expected the effects that the developer layer which has been tamped by passing by the doctor blade can be softened and that the developing performance can be improved.

What is claimed is:

1. In a magnetic brush developing device for developing an electrostatic latent image formed on a charge retaining member, which includes a housing for containing developer, a developing sleeve arranged rotatably in said housing, a plurality of magnets interior of said developing sleeve and a doctor blade for regulating a thickness of a developer layer formed on a circumferential surface of said developing sleeve by a magnetic flux of said magnets, the improvement comprising:

a magnetic material fixed on an internal surface of said housing and downstream of said doctor blade as viewed from the direction of the rotation of said developing sleeve, said magnetic material extending in the direction of the width of said developing sleeve, and being spaced from said circumferential surface of said developing sleeve, and said magnetic material being positioned opposite to at least one of said magnets arranged in said developing sleeve.

2. A magnetic brush developing device according to claim 1, wherein a width (L1) of said magnetic material is narrower than a width (L2) of one of the magnets.

3. A magnetic brush developing device according to claim 1 or 2, wherein said magnetic material is an iron member.

4. A magnetic brush developing device according to claim 3, wherein said iron member is an elongated bar-like member extending across substantially the whole width of said developing sleeve.

5. A magnetic brush developing device according to claim 1, wherein said magnetic material is an elongated bar-like member extending across substantially the whole width of said developing sleeve.

6. A magnetic brush developing device according to claim 1 or 5, wherein said magnetic material is not permanently magnetized.

7. In an electrophotographic copying machine including a charge retaining member for forming an electrostatic latent image, and a magnetic brush developing device for developing said electrostatic latent image formed on said charge retaining member, the improvement wherein said magnetic brush developing device comprises a housing for containing developer, a developing sleeve arranged rotatably in said housing, a plurality of magnets interior of said developing sleeve, a doctor blade for regulating a thickness of a developer layer formed on a circumferential surface of said developing sleeve by a magnetic flux of said magnets, and a magnetic material fixed on an internal surface of said housing and downstream of said doctor blade as viewed from the direction of the rotation of said developing sleeve, said magnetic material extending in the direction of the width of said developing sleeve, and being spaced from said circumferential surface of said developing sleeve, and said magnetic material being positioned opposite to at least one of said magnets arranged in said developing sleeve.

8. A copying machine according to claim 7, wherein a width (L1) of said magnetic material is narrower than a width (L2) of one of the magnets.

9. A copying machine according to claim 7 or 8, wherein said magnetic material is an iron member.

10. A copying machine according to claim 9, wherein said iron member is an elongated bar-like member extending across substantially the whole width of said developing sleeve.

11. A copying machine according to claim 7, wherein said magnetic material is an elongated bar-like member extending across substantially the whole width of said developing sleeve.

12. A copying machine according to claim 7 or 11, wherein said magnetic material is not permanently magnetized.

* * * * *

UNITED STATES PATENT AND TRADEMARK OFFICE

CERTIFICATE OF CORRECTION

PATENT NO. : 4,428,661

DATED : January 31, 1984

INVENTOR(S) : Keiji MASUDA, et al

It is certified that error appears in the above-identified patent and that said Letters Patent is hereby corrected as shown below:

Column 2, line 13, after "direction of the" change "developing width of said sleeve," to --width of said developing sleeve,--;

Column 2, line 20, after "developing" insert --device of--;

Column 2, line 30, after "photosensitive drum" insert --1--;

Column 2, line 31, after "1a and" delete "1";

Column 3, line 19, after "piece 11" change "is faced" to --faces--;

Column 3, line 21, after "blade 7" change "as views" to --as viewed--;

Column 3, line 33, change "Preferring" to --Referring--;

Column 3, line 41, before "such as" change "space" to --spacer--.

Signed and Sealed this

*Fifth* Day of *February 1985*

[SEAL]

*Attest:*

DONALD J. QUIGG

*Attesting Officer* *Acting Commissioner of Patents and Trademarks*